US006595871B2

(12) United States Patent
Sano

(10) Patent No.: US 6,595,871 B2
(45) Date of Patent: Jul. 22, 2003

(54) GOLF CLUB HEAD

(75) Inventor: Yoshinori Sano, Kobe (JP)

(73) Assignee: Sumitomo Rubber Industries, Ltd., Kobi (JP)

( * ) Notice: Subject to any disclaimer, the term of this patent is extended or adjusted under 35 U.S.C. 154(b) by 0 days.

(21) Appl. No.: 09/954,058

(22) Filed: Sep. 18, 2001

(65) Prior Publication Data

US 2002/0065147 A1 May 30, 2002

(30) Foreign Application Priority Data

Oct. 11, 2000 (JP) ..... 2000-310952

(51) Int. Cl.[7] ..... A63B 53/04
(52) U.S. Cl. ..... 473/342; 473/346
(58) Field of Search ..... 473/324, 329, 473/332, 345, 346, 342, 349, 350

(56) References Cited

U.S. PATENT DOCUMENTS 4,214,754 A * 7/1980 Zebelean
4,438,931 A * 3/1984 Motomiya
5,176,384 A * 1/1993 Sata
5,180,166 A * 1/1993 Schmidt
5,213,328 A * 5/1993 Long
5,261,663 A * 11/1993 Anderson
5,294,037 A * 3/1994 Schmidt
5,489,098 A * 2/1996 Gojny
5,509,660 A * 4/1996 Elmer
5,718,645 A * 2/1998 Chang
5,735,755 A * 4/1998 Kobayashi
5,755,627 A * 5/1998 Yamazaki
5,871,408 A * 2/1999 Chen
6,042,486 A * 3/2000 Gallagher

FOREIGN PATENT DOCUMENTS

| | | |
|---|---|---|
| JP | 63154186 | 6/1988 |
| JP | 511969 | 2/1993 |
| JP | 5137818 | 6/1993 |
| JP | 6142236 | 5/1994 |

* cited by examiner

*Primary Examiner*—Sebastiano Passaniti
(74) *Attorney, Agent, or Firm*—Birch, Stewart, Kolasch & Birch, LLP

(57) ABSTRACT

A golf club head which comprises a face portion defining a face for hitting a golf ball, and a side portion between a crown portion and a sole portion, extending from a toe-side edge of the face portion to a heel-side edge of the face portion through the back face of the head, wherein the face portion is composed of a face plate and a face side part on one of or each of the toe side and heel side of the face plate, and the face side part is formed integrally with the side portion, but the face plate is formed separately from the face side part and welded to the face side part. The ratio of the area of the face side part to the area of the face plate is preferably set in a range of from 0.05 to 0.2.

17 Claims, 9 Drawing Sheets

GOLF CLUB HEAD

BACKGROUND OF THE INVENTION

The present invention relates to a golf club head, more particularly to a structure for the face portion being capable of reducing variations in the visible outline and outside dimension of the golf club head.

In a golf club head in which, as shown in FIG. 13A, a face plate (b) is welded to the head main (c), the weld run (k) shown in FIG. 13B has to be removed by a grinder. The weld run (k) is, as shown in FIG. 14A, situated in the corner of the face (b). Thus, the grind work is difficult and requires skill. Further, the welding is also difficult.

In this structure, as the weld run (k) is in the corner, the welded part is liable to be ground too much over the target line (n) as shown in FIG. 14B. Thus, it is difficult to reduce the variations in the visible outline and outside dimension of the golf club head.

In general, in an address position, a golfer gives attention to the toe-side edge part (e) and heel-side edge part (f) of the hitting face. (see FIG. 2) Therefore, the accuracy of the shape and dimensions of such edge parts (e) and (f) in the top view of the head is very important.

SUMMARY OF THE INVENTION

It is therefore, an object of the present invention to provide a golf club head in which the above-mentioned variations in the shape and dimensions can be reduced.

According to the present invention, a golf club head comprises a face portion defining a face for hitting a golf ball, and a side portion between a crown portion and a sole portion, extending from a toe-side edge of the face portion to a heel-side edge of the face portion through the back face of the head, wherein the face portion is composed of a face plate and a side part on one of or each of the toe side and heel side of the face plate, and the side part is formed integrally with the side portion, but the face plate is formed separately from the side part and welded to the side part.

DESCRIPTION OF THE PREFERRED EMBODIMENTS

Embodiments of the present invention will now be described in detail in conjunction with the accompanying drawings.

Figure 1:
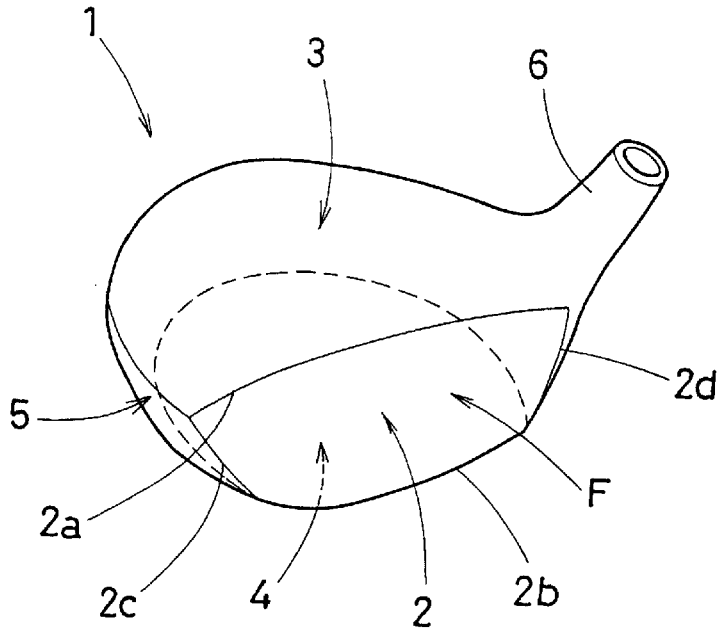
FIG. 1 is a perspective view of a golf club head according to the present invention.

FIG. 1 shows a golf club head 1 according to the present invention. In this example, the head 1 is a wood-shaped metallic head for a wood club. The head 1 is hollow and comprises: a face portion 2 defining a hitting face F for hitting a golf ball; a crown portion 3 which extends from the upper edge 2*a* of the face portion 2, defining a upper surface of the head; a sole portion 4 which extends from the lower edge 2*b* of the face portion 2, defining a bottom surface of the head; a side portion 5 between the crown portion 3 and sole portion 4 which side portion extends from the toe-side edge 2*c* of the face portion 2 to the heel-side edge 2*d* of the face portion 2 through the back face of the head; and a neck portion 6 fixed to a shaft (not shown).

Figure 2:
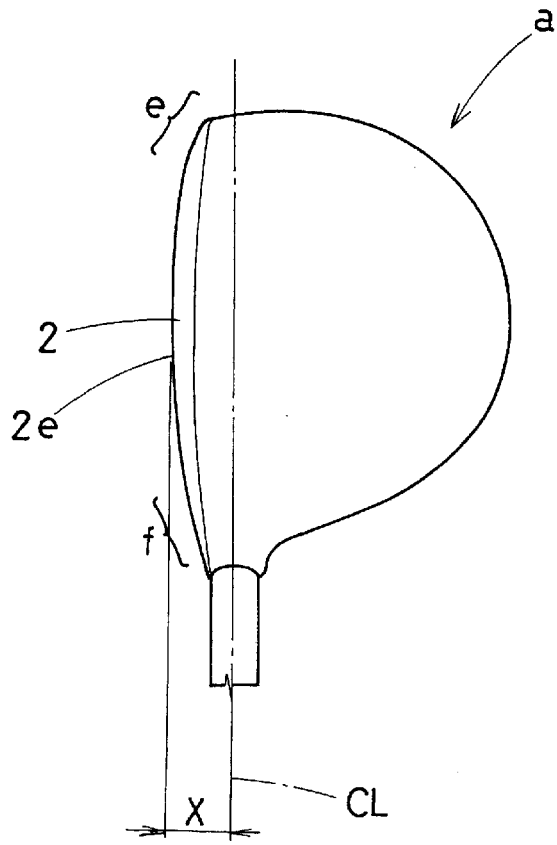
FIG. 2 is a top view of the golf club head.

FIG. 2 shows a top view of the head 1 which is set on a horizontal plane (H) satisfying its designed lie angle (alpha) and loft angle. (hereinafter the "standard state" of the head)

As shown in FIG. 2, the hitting face F is curved and slightly bulged out and the head 1 has a face progression X.

FIRST EXAMPLE

Figure 3:
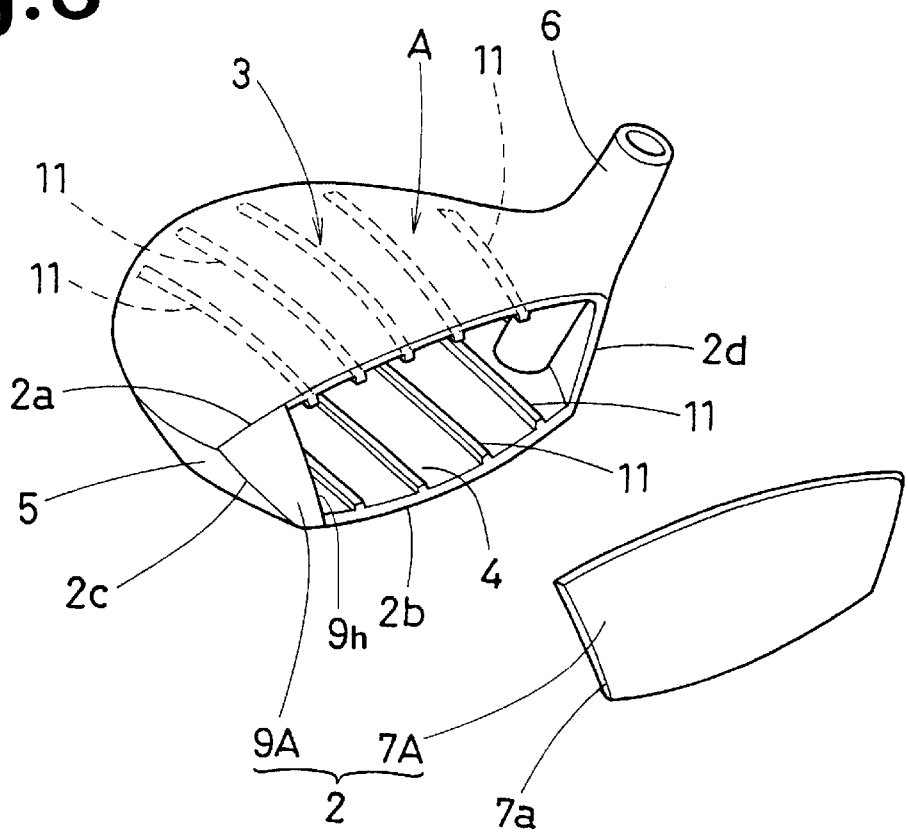
FIG. 3 is an exploded view showing an example of the structure for the golf club head.

FIG. 3 is an exploded view showing an exemplary structure for the head 1.

The face portion 2 in this example is made up of a face plate 7A and a part 9A on the toe side of the face plate 7A. This toe-side part 9A is formed integrally with at least the side portion 5. But, the face plate 7B is formed separately from the toe-side part 9A and welded to the toe-side part 9A. The toe-side part 9A extends from the toe-side edge 2*c* of the face portion 2 towards the heel-side edge 2*d* of the face portion 2.

Figure 4:
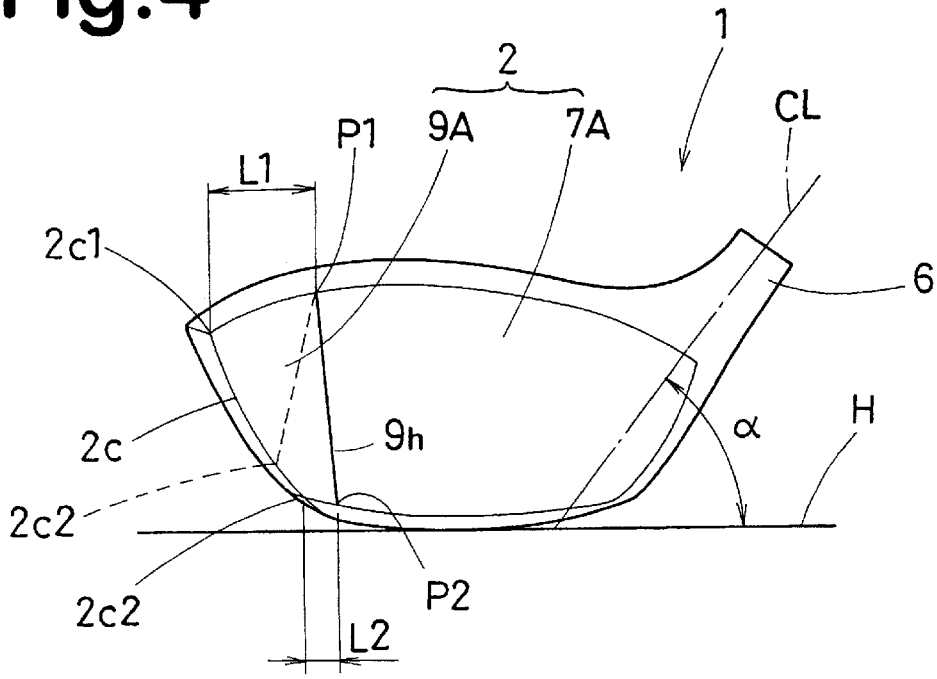
FIG. 4 is a perspective view showing a weld run occurring in the structure shown in FIG. 3.

In FIG. 4 which is a front view of the head under the above-mentioned standard state, the toe-side part 9A has a heel-side edge 9*h* which is substantially straight and extends up and down across the face portion 2 from the upper edge to the lower edge of the face portion 2.

Under the standard state, the distance L1 in the horizontal direction between the upper end P1 of the heel-side edge 9*h* and the upper end 2*c*1 of the toe-side edge 2*c* of the face portion 2 is set in a range of from 3 to 30 mm, preferably 3 to 20 mm, more preferably 5 to 15 mm. If the length L1 is less than 3 mm, the accuracy of finishing is liable to be lowered by welding and/or grinding work. If the length L1 is more than 30 mm, there is a tendency for the face portion 2 to decrease the impact resilience.

Further, the distance L2 in the horizontal direction between the lower end P2 of the heel-side edge 9*h* and the lower end 2*c*2 of the toe-side edge 2*c* is set in range of from −15 to +25 mm, preferably −10 to +20 mm, more preferably −10 to +10 mm. Here, the positive value means that the lower end P2 is located on the heel-side of the lower end 2*c*2, and accordingly the negative value means that the lower end P2 is located on the toe-side of the lower end 2*c*2.

The face plate 7A has a shape corresponding to the face portion 2 from which the toe-side part 9A is removed. The heel-side edge 9*h* of the toe-side part 9A and a toe-side edge 7*a* of the face plate 7A are butt welded.

SECOND EXAMPLE

Figure 5:
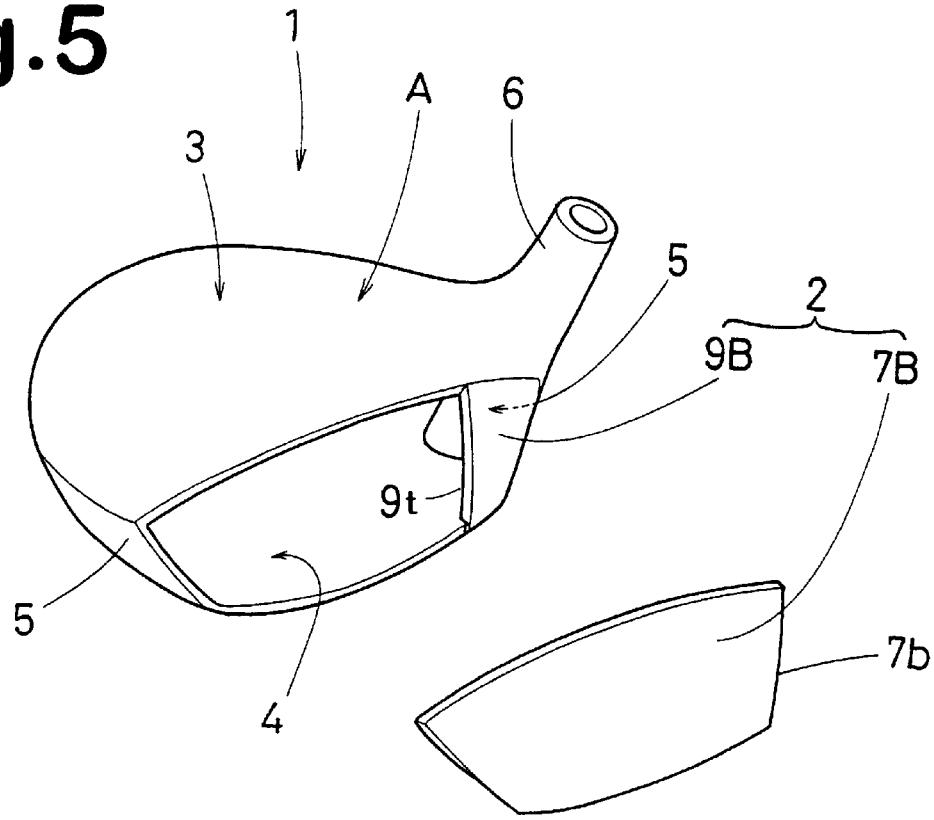
FIG. 5 is a front view of the golf club head having the structure shown in FIG. 3.

FIG. 5 is an exploded view showing another example of the structure for the head 1.

The face portion 2 in this example is made up of a face plate 7B and a part 9B on the heel side of the face plate 7B. The heel-side part 9B is formed integrally with at least the side portion 5. But, the face plate 7B is formed separately from the heel-side part 9B and welded to the heel-side part 9B. The heel-side part 9B extends from the heel-side edge 2*d* of the face portion 2 towards the toe-side edge 2*c* of the face portion 2.

Figure 6:
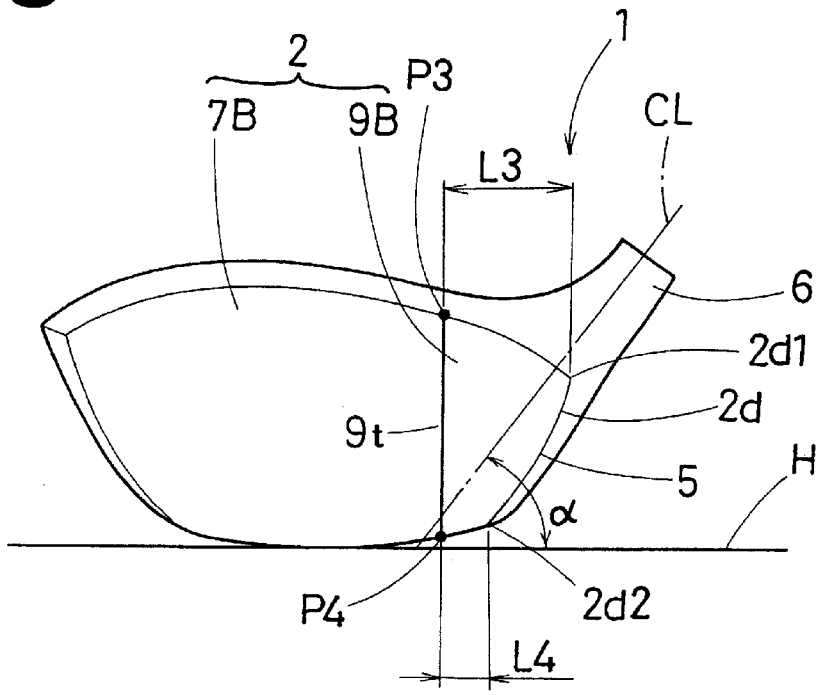
FIG. 6 is an exploded view showing another example of the structure for the golf club head.

In FIG. 6 which is a front view of the head under the above-mentioned standard state, the heel-side part 9B has a toe-side edge 9*t* which is substantially straight and extends up and down across the face portion 2 from the upper edge to the lower edge of the face portion 2.

Under the standard state, the distance L3 in the horizontal direction between the upper end P3 of the toe-side edge 9*t* and the upper end 2*d*1 of the heel-side edge 2*d* of the face portion 2 is set in a range of from 3 to 30 mm, preferably 3 to 20 mm, more preferably 5 to 15 mm. If the distance L3 is less than 3 mm, the accuracy of finishing is liable to be lowered by welding and/or grinding work. If the distance L3 is more than 30 mm, there is a tendency for the face portion 2 to decrease the impact resilience.

Further, the distance L4 in the horizontal direction between the lower end P4 of the toe-side edge 9*t* and the lower end 2*d*2 of the heel-side edge 2*d* is set in a range of from −15 to +25 mm, preferably −10 to +20 mm, more preferably −10 to +10 mm. Here, the positive value means that the lower end P4 is located on the toe-side of the lower end 2*d*2, and accordingly the negative value means that the lower end P4 is located on the heel-side of the lower end 2*d*2.

The face plate 7B has a shape corresponding to the face portion 2 from which the heel-side part 9B is removed. The toe-side edge 9*t* of the heel-side part 9B and a heel-side edge 7*b* of the face plate 7B are butt welded.

THIRD EXAMPLE

Figure 7:
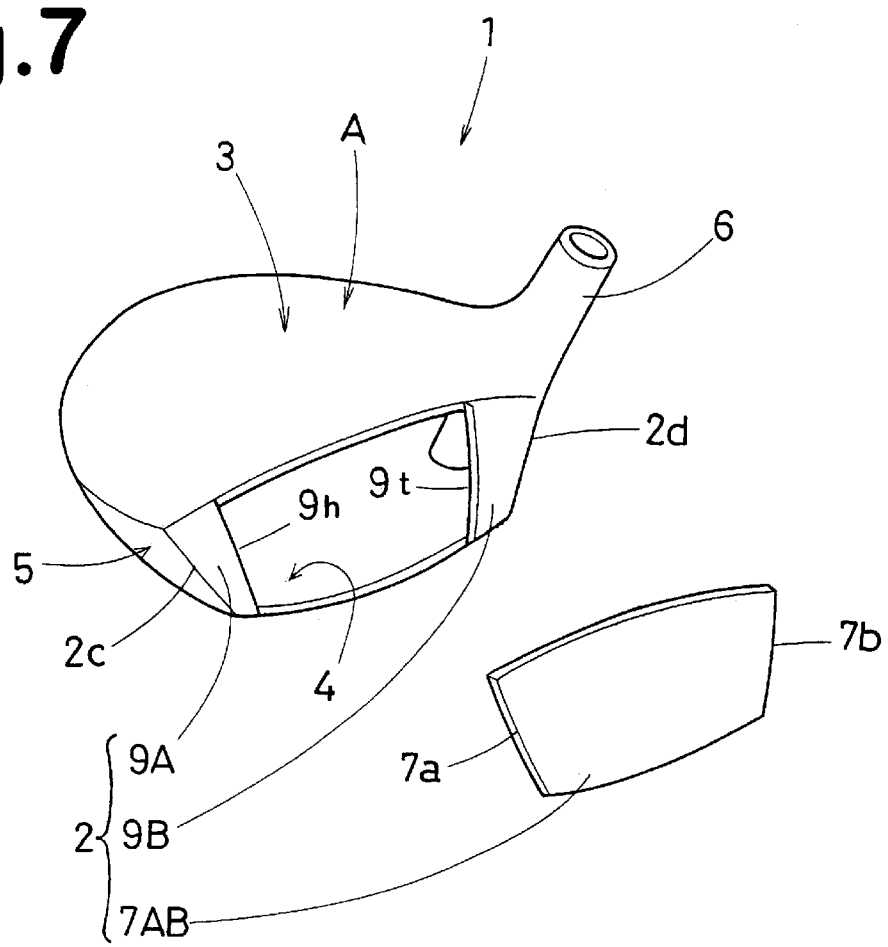
FIG. 7 is a front view of the golf club head having the structure shown in FIG. 6.

FIG. 7 is an exploded view showing still another example of the structure for head 1.

The face portion 2 in this example is made up of a face plate 7AB, a part 9A on the toe side of the face plate 7AB, and a part 9B on the heel side of the face plate 7AB. The toe-side part 9A and heel-side part 9B are formed integrally with at least the side portion 5. But, the face plate 7AB is formed separately from the toe-side part 9A and heel-side part 9B and welded to these parts 9A and 9B.

The toe-side part 9A extends from the toe-side edge 2*c* of the face portion 2 towards the heel-side edge 2*d* of the face portion 2. The heel-side part 9B extends from the heel-side edge 2*d* of the face portion 2 towards the toe-side edge 2*c* of the face portion 2.

Figure 8:
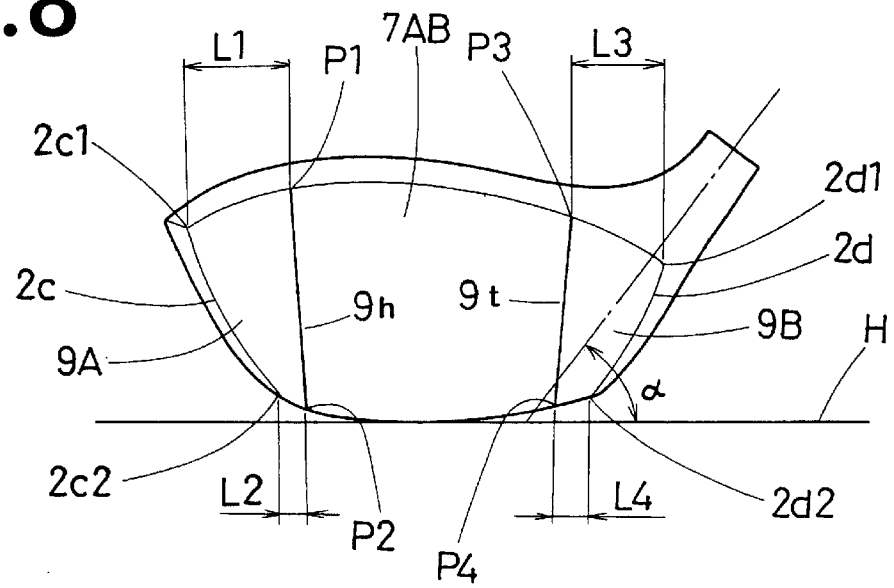
FIG. 8 is an exploded view showing another example of the structure for the golf club head.

In FIG. 8 which is a front view of the head under the above-mentioned standard state, the toe-side part 9A has a heel-side edge 9*h* which is substantially straight and extends up and down across the face portion 2 from the upper edge to the lower edge of the face portion 2. And the heel-side part 9B has a toe-side edge 9*t* which is substantially straight and extends up and down across the face portion 2 from the upper edge to the lower edge of the face portion 2.

As to the distances L1, L2, L3 and L4 as defined in the former two examples, the same limitations as in the former two examples may be applied to this third example.

The face plate 7AB has a shape corresponding to the face portion 2 from which the toe-side part 9A and heel-side part 9B are removed. The heel-side edge 9*h* of the toe-side part 9A and a toe-side edge 7*a* of the face plate 7AB are butt welded. The toe-side edge 9*t* of the heel-side part 9B and a heel-side edge 7*b* of the face plate 7AB are butt welded.

Crown Portion and Other Portions

In the above-mentioned three examples shown in FIGS. 3–8, the crown portion 3, sole portion 4 and neck portion 6 are formed integrally with the side portion 5. Accordingly, the head excepting the face plate (7A, 7B and 7AB generically "7"), namely, the head main (A) including the crown portion 3, sole portion 4, side portion 5, neck portion 6 and (the toe-side part 9A and/or the heel-side part 9B) is monolithic. To make the head main (A), monobloc precision casting, in this example lost-wax precision casting is used. The material used is a titanium alloy (6Al-4V-Ti) which can display high strength in the precision casting. Thus, the head main (A) is a monocoque body of 6Al-4V-Ti. Needless to say, other materials can be used. Further, aside from the lost-wax precision casting, other casting, forging, pressing and the like may be used.

It may be possible to form the crown portion 3, sole portion 4 and/or neck portion 6 separately from the toe-side part 9A and side portion 5. However, it is preferable that the crown portion 3 and neck portion 6 are formed integrally with the side parts 9A, 9B and side portion 5. Thereby, the edges of the lengths L1, L2, L3 and L4 can be formed with high precision by the casting without need of welding.

Face Plate

The face plate 7 has a thickness in a range of from 0.5 to 5 mm, preferably 1 to 4 mm, more preferably 2 to 3 mm, and the face plate 7 is slightly curved. For example, the face plate 7 can be formed by pressing a metallic plate of a titanium alloy (Ti-15V-3Cr-3Al-3Sn) which is superior in impact resilience. Also it is possible to form the face plate 7 by forging, casting and the like.

The face plate 7, toe-side part 9A and heel-side part 9B have the substantially same thicknesses.

Area Ratio S2/S1

Here, the total area S2 of the toe-side part 9A and heel-side part 9B which forms a part of the hitting face F is set in a range of from 0.05 to 0.2, preferably 0.5 to 0.18, more preferably 0.07 to 0.15 times the area S1 of the face plate 7 which forms the remaining part of the hitting face F. If the ratio (S2/S1) is less than 0.05, the accuracy of finishing is liable to be lowered by welding and/or grinding work. If the ratio (S2/S1) is more than 0.2, the effective hitting area decreases. Incidentally, the effective hitting area is such area that the coefficient of restitution is not less than 90% of that at the sweet spot. The restitution coefficient can be obtained according to the "Procedure for Measuring the Velocity Ratio of a Club Head for Conformance to Rule 4-1e, Appendix II, Revision 2 (Feb. 8, 1999), United States Golf Association."

Weld Run and Inside Groove

Figure 9:
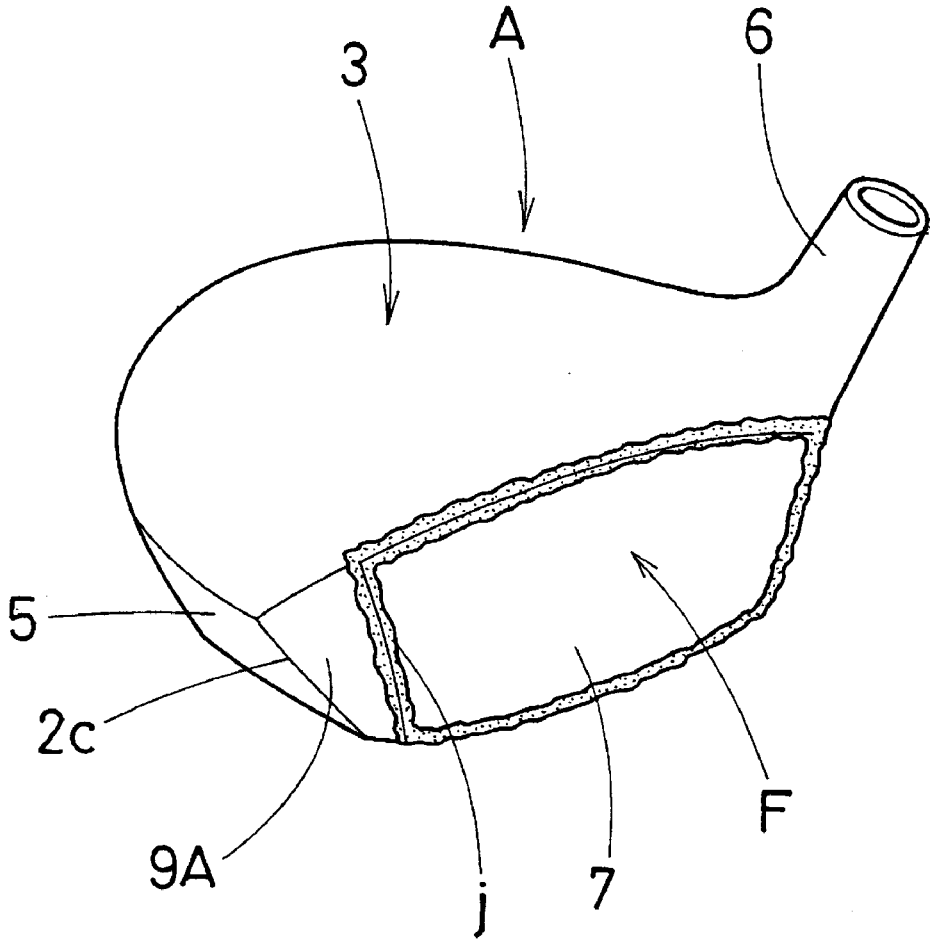
FIG. 9 is a front view of the golf club head having the structure shown in FIG. 8.
Figure 10A:
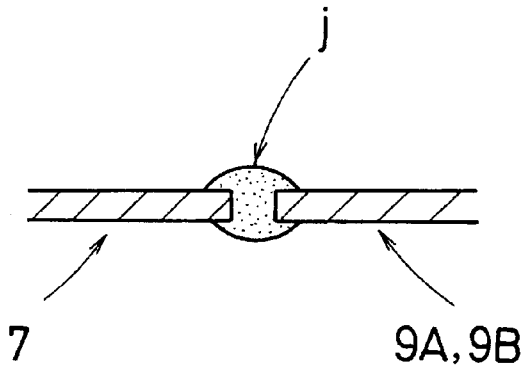
FIGS. 10A and 10B are cross sectional views of a welded part before and after flattened.
Figure 10B:
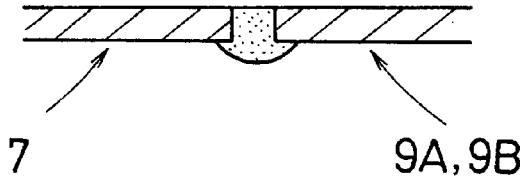

FIG. 9 shows a state that a face plate 7 is welded to a head main (A), taking the first example shown in FIG. 3 as a representative example. As a weld run (j) is formed around the face plate 7, the hitting face F is crossed by the weld run (j) in a vertical direction. The weld run (j) on the outside of the head including the hitting face F is removed by a grinder, but the weld run (j) on the inside of the head remains partially increasing the thickness of the face portion 2, as shown in FIGS. 10A and 10B. This tends to decrease the flexibility of the face portion 2 and to lower the impact resilience.

Figure 11A:
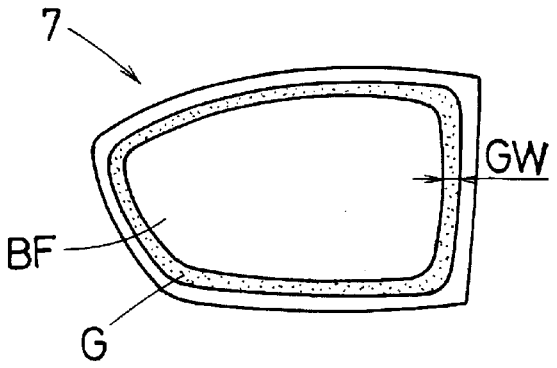
FIGS. 11A, 11B and 11C shows grooves which may be provided on the inner surface of a face plate.
Figure 11B:
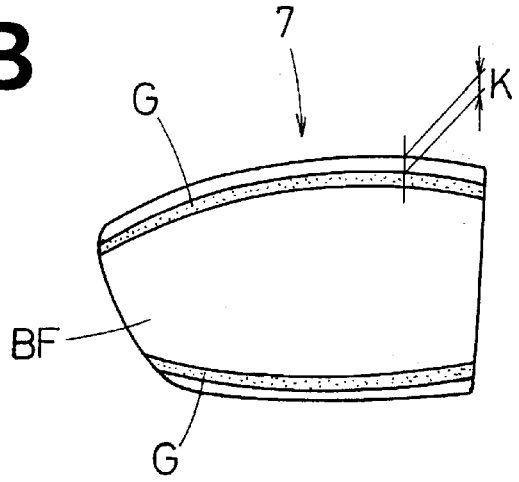
Figure 11C:
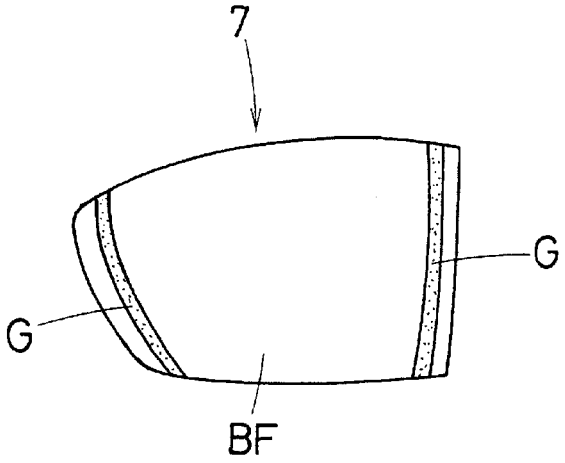

In order to make compensation therefor, as shown in FIGS. 11A, 11B and 11C, the inner surface BF of the face plate 7 is preferably provided along the periphery thereof with a groove G which faces the hollow of the head. The groove G increases the flexibility of the face plate 7 and as a result, the impact resilience of the face portion 2 can be prevented from decreasing. As shown in FIG. 11A, the groove G may be looped along the periphery of the inner surface BF. Further, the groove G may formed along each of the upper edge and lower edge of the face plate 7 as shown in FIG. 11B. Further, it is also possible that the groove G is formed along each of the toe-side edge and heel-side edge of the face plate 7 as shown in FIG. 11C. In any case, the distance K between the groove G and the edge of the face plate 7 is set in a range of from 1 to 5 mm, preferably 1 to 3 mm.

If the width GW and depth GD of the groove G are too large, then the strength of the face plate 7 decreases. If the width GW and depth GD of the groove G are too small, then the impact resilience can not be improved. Therefore, the width GW is set in a range of from 1.0 to 10.0 mm, preferably 3.0 to 7.0 mm. The depth GD is set in a range of from 0.1 to 2.0 mm, preferably 0.1 to 1.0 mm.

Inside Rib

Figure 12:
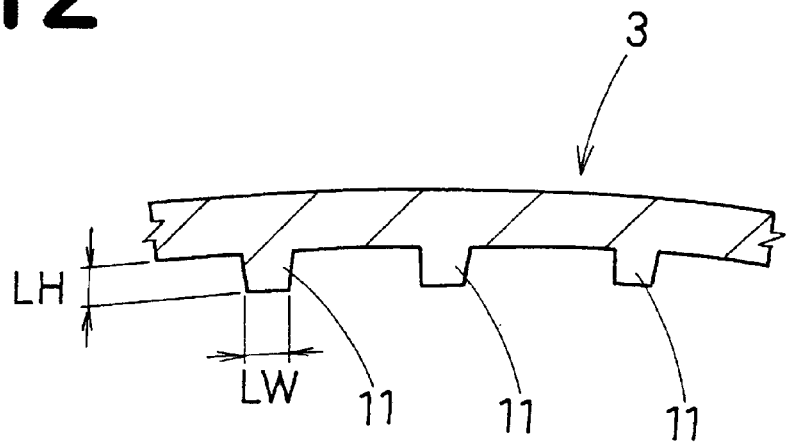
FIG. 12 is an enlarged cross sectional view showing ribs which may be provided on the inner surface of a crown portion and sole portion of the head.

The head main (A) in the above three examples may be provided on the inner surface of the sole portion 4 and/or crown portion 3 with at least one rib 11 as shown in FIG. 3 and FIG. 12.

The ribs 11 are arranged at the substantially same intervals. But, the intervals may be varied according to the thickness distribution in each portion, the shape of each portion and the like. The number of the ribs 11 in each portion 3, 4 is preferably set in a range of from 3 to 15, more preferably 4 to 11. Aside from the substantially straight rib 11 used in this example, it is also possible to use a slightly curved rib.

By providing such ribs 11 in this way, the crown portion 3 and/or sole portion 4 can be effectively improved in bending rigidity at the time of hitting a golf ball. Further, when the sole portion 4 is provided with such ribs 11, a favorable sharp high note hit sound can be obtained.

Comparison Tests

Golf club heads having the same wood type shape shown in FIGS. 1 and 2 but different structures were made and inspected as follows. The results and the specifications are shown in Table 1.

Defectiveness: Visual inspection of the outline of the head especially in the toe-side edge part (e) and heel-side edge part (f) (see FIG. 2) was made to obtain the percent defective. In Table 1, the percent defective is indicated by an index based on Ref. 1 being 100, wherein the smaller the index number, the smaller the percent defective.

Face Progression: The face progression was measured to obtain variation and the standard deviation thereof is indicated in Table 1, wherein the smaller the number, the smaller the variation. Here, the face progression was measured as a horizontal distance X of the extreme end 2*e* of the face from the center line of the shaft hole of the neck portion or that of the shaft under the standard state as shown in FIG. 2.

TABLE 1

Figure 13A:
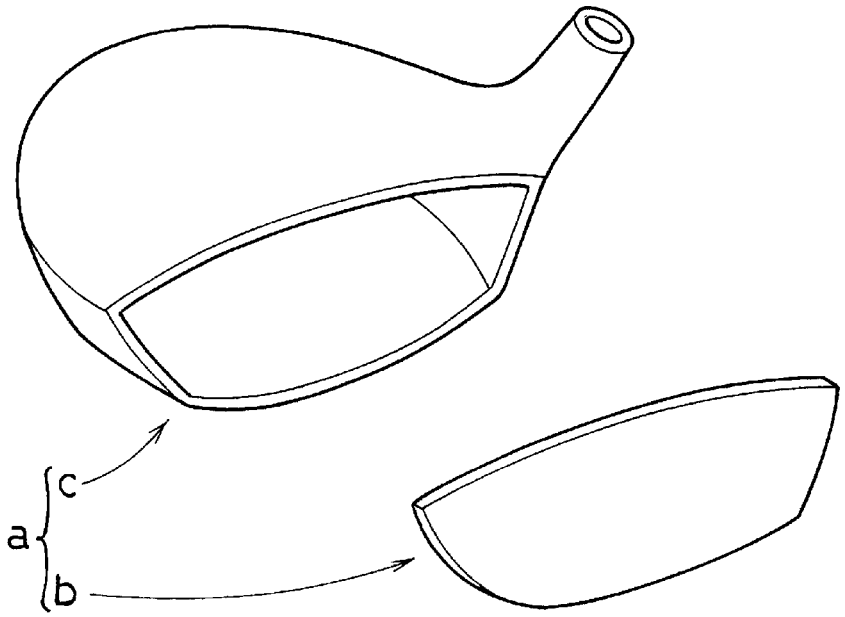
FIG. 13A is an exploded view showing the prior art structure.
Figure 13B:
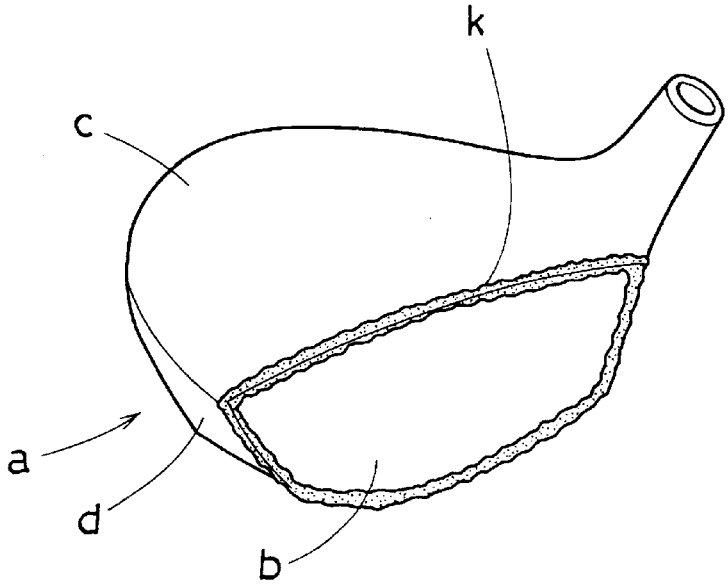
FIG. 13B shows a weld run occurring in this structure.
Figure 14A:
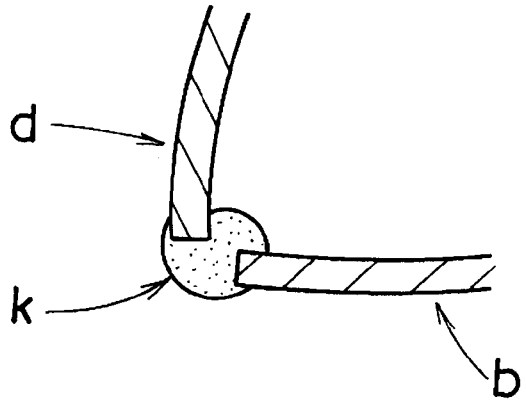
FIG. 14A is an enlarged cross sectional view of the welded part thereof.
Figure 14B:
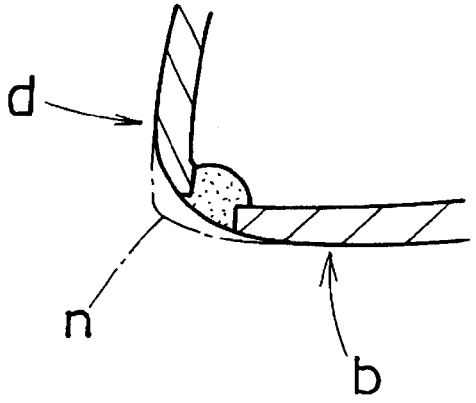
FIG. 14B is an enlarged cross sectional view for explaining problems in the prior art.

| Head*1 | Ref. 1 | Ex. 1 | Ex. 2 | Ex. 3 | Ex. 4 | Ex. 5 | Ex. 6 |
|---|---|---|---|---|---|---|---|
| Structure | FIG. 13A | FIG. 3 | FIG. 5 | FIG. 7 | FIG. 7 | FIG. 7 | FIG. 7 |
| L1 (mm) | | 5 | | 10 | 15 | 10 | 10 |
| L2 (mm) | | −13 | | −5 | 5 | −5 | −5 |
| L3 (mm) | | | 5 | 5 | 15 | 5 | 5 |
| L4 (mm) | | | −13 | −5 | 5 | −5 | −5 |
| S2/S1 | 0 | 0.06 | 0.08 | 0.11 | 0.14 | 0.11 | 0.11 |
| Groove | none | none | none | none | none | FIG. 11B*2 | none |
| Rib | none | none | none | none | none | none | FIG. 3*3 |
| Defectiveness | 100 | 50 | 60 | 30 | 25 | 30 | 30 |
| Face progression (mm) SD | 0.55 | 0.34 | 0.39 | 0.26 | 0.2 | 0.26 | 0.27 |

*1 Sample number was 50
*2 Groove's sectional shape: Semicircle of 1.5 mm radius (width 3 mm, depth 1.5 mm) Distance K: 1 to 2 mm
*3 The crown portion and sole portion were each provided with six ribs (width 1.0 mm, height 1.5 mm) at substantially regular intervals as shown in FIG. 3.

In the illustrated example, each of the crown portion 3 and sole portion 4 is provided with a plurality of ribs 11 each extending substantially perpendicularly to the hitting face F from the face portion 2 to the side portion 5 at the rear of the head.

If the width LW and height LH of the rib 11 are too large, the weight of the head unfavorably increases. If the width LW and height LH are to small, it is difficult to improve the rigidity of the crown portion 3 and/or sole portion 4. Therefore, the width LW is set in a range of from 0.5 to 3 mm, preferably 0.5 to 2 mm. The height LH is set in a range of from 0.1 to 3.5 mm, preferably 0.1 to 2 mm.

As described above, in the golf club head in the present invention, as the face plate is connected to the face side part, the positioning of the face plate can be easily done by butting their edges each other, and it is easier to make the surface of the face plate and the surface of the face side part at the same level. Further, as the removing of the weld run is from a plane not a corner, the grinding work is easier and it is easy to avoid too-much grinding. Therefore, the positioning accuracy is greatly improved, and the accuracy of the outside dimension such as face progression can be improved. The deterioration of the visible outline can be prevented.

What is claimed is:

1. A golf club head comprising a face portion defining a hitting face for hitting a golf ball, and a side portion between a crown portion and a sole portion, extending from a toe-side edge of the face portion to a heel-side edge of the face portion through the back face of the head, the face portion consisting of a face plate and a side part on one of or each of the toe side and heel side of the face plate, and the side part formed integrally with the side portion, but the face plate formed separately from the side part and welded to the side part, wherein an edge of the side part abutting on the face plate extends from an upper edge to a lower edge of the face portion, the face plate is provided on the inner surface thereof with a groove facing a hollow of the head, the groove extending along an edge of the face plate, and the distance between the groove and the edge is in a range of from 1 to 5 mm.

2. The golf club head according to claim 1, wherein the ratio (S2/S1) of the area S2 of the side part to the area S1 of the face plate is in a range of from 0.05 to 0.2.

3. The golf club head according to claim 2, wherein an inner surface of the crown portion is provided with a rib.

4. The golf club head according to claim 2, wherein an inner surface of the sole portion is provided with a rib.

5. The golf club head according to claim 2, wherein an inner surface of the crown portion is provided with a rib, and an inner surface of the sole portion is provided with a rib.

6. The golf club head according to claim 1, wherein an inner surface of the crown portion is provided with a rib.

7. The golf club head according to claim 1, wherein an inner surface of the sole portion is provided with a rib.

8. The golf club head according to claim 1, wherein an inner surface of the crown portion is provided with a rib, and an inner surface of the sole portion is provided with a rib.

9. The golf club head according to claim 1, wherein an inner surface of the crown portion is provided with a rib having a width of from 0.5 to 3 mm and a height of from 0.1 to 3.5 mm.

10. The golf club head according to claim 1, wherein an inner surface of the sole portion is provided with a rib.

11. The golf club head according to claim 1, wherein an inner surface of the crown portion is provided with a rib, and an inner surface of the sole portion is provided with a rib, and each of the ribs has a width of from 0.5 to 3 mm and a height of from 0.1 to 3.5 mm.

12. A golf club head comprising a face portion defining a hitting face for hitting a golf ball, and a side portion between a crown portion and a sole portion, extending from a toe-side edge of the face portion to a heel-side edge of the face portion through the back face of the head, wherein the face portion consists of a face plate and a side part on each of the toe side and heel side of the face plate, said side part is formed integrally with the side portion, but the face plate is formed separately from the side part and welded to the side part, an edge of the side part abutting on the face plate extends from an upper edge to a lower edge of the face portion, the face plate is provided on the inner surface with a groove facing a hollow of the head, and the distance of the groove from the edge of the face plate is in a range of from 1 to 5 mm.

13. A golf club head comprising a face portion defining a hitting face for hitting a golf ball, and a side portion between a crown portion and a sole portion, extending from a toe-side edge of the face portion to a heel-side edge of the face portion through the back face of the head, wherein the face portion consists of a face plate and a side part on the toe side of the face plate, said side part is formed integrally with the side portion, but the face plate is formed separately from the side part and welded to the side part, an edge of the side part abutting on the face plate extends from an upper edge to a lower edge of the face portion, the face plate is provided on the inner surface with a groove facing a hollow of the head, and the distance of the groove from the edge of the face plate is in a range of from 1 to 5 mm.

14. A golf club head comprising a face portion defining a hitting face for hitting a golf ball, and a side portion between a crown portion and a sole portion, extending from a toe-side edge of the face portion to a heel-side edge of the face portion through the back face of the head, wherein the face portion consists of a face plate and a side part on the heel side of the face plate, said side part is formed integrally with the side portion, but the face plate is formed separately from the side part and welded to the side part, an edge of the side part abutting on the face plate extends from an upper edge to a lower edge of the face portion, the face plate is provided on the inner surface with a groove facing a hollow of the head, and the distance of the groove from the edge of the face plate is in a range of from 1 to 5 mm.

15. The golf club head according to claim 1, 12, 13, or 14, wherein said groove comprises a groove segment extending along an upper edge of the face plate so that the distance between the groove and the upper edge is in a range of from 1 to 5 mm, and a groove segment extending along a lower edge of the face plate so that the distance between the groove and the lower edge is in a range of from 1 to 5 mm.

16. The golf club head according to claim 1, 12, 13, or 14, wherein said groove comprises a groove segment extending along a toe-side edge of the face plate so that the distance between the groove and the toe-side edge is in a range of from 1 to 5 mm, and a groove segment extending along a heel-side edge of the face plate so that the distance between the groove and the heel-side edge is in a range of from 1 to 5 mm.

17. The golf club head according to claim 1, 12, 13, or 14, wherein said groove is an annular groove extending along the entire edge of the face plate, and the distance between the groove and the edge is in a range of from 1 to 5 mm.

* * * * *